US007467586B2

(12) United States Patent
Jentzsch et al.

(10) Patent No.: US 7,467,586 B2
(45) Date of Patent: Dec. 23, 2008

(54) SYSTEM FOR DRIVING DAMPING ROLLERS IN ROTARY PRINTING MACHINES

(75) Inventors: Arndt Jentzsch, Coswig (DE); Christian Ziegenbalg, Weinböhla (DE); Martin Riese, Radebeul (DE); Bodo Zirnstein, Radebeul (DE)

(73) Assignee: Koneig & Bauer AG, Radebeul (DE)

( * ) Notice: Subject to any disclaimer, the term of this patent is extended or adjusted under 35 U.S.C. 154(b) by 0 days.

(21) Appl. No.: 11/114,824

(22) Filed: Apr. 26, 2005

(65) Prior Publication Data

US 2005/0247217 A1 Nov. 10, 2005

(30) Foreign Application Priority Data

May 6, 2004 (DE) ..... 10 2004 022 889

(51) Int. Cl.
*B41L 25/02* (2006.01)

(52) U.S. Cl. ..... 101/148; 101/147; 101/451; 118/258; 118/262

(58) Field of Classification Search ..... None
See application file for complete search history.

(56) References Cited

U.S. PATENT DOCUMENTS 3,508,489 A 4/1970 Norton
3,688,694 A * 9/1972 Preuss et al. ..... 101/148
4,240,346 A * 12/1980 Landis et al. ..... 101/139
4,567,823 A * 2/1986 Hummel et al. ..... 101/148
4,724,764 A 2/1988 MacPhee et al.
4,972,771 A * 11/1990 Weisgerber et al. ..... 101/148
5,046,418 A * 9/1991 Koehler et al. ..... 101/148
5,551,338 A * 9/1996 Wall et al. ..... 101/148
5,826,505 A 10/1998 Volz et al.
5,884,557 A * 3/1999 Furbass ..... 101/148
6,298,779 B1 * 10/2001 Gotanda et al. ..... 101/350.1

FOREIGN PATENT DOCUMENTS

DE 238 574 A1 8/1986
DE 4414269 10/1995
DE 298 25 013 U1 3/2004
EP 0812683 12/1997

* cited by examiner

*Primary Examiner*—Jill E. Culler
(74) *Attorney, Agent, or Firm*—Goodwin Procter LLP

(57) ABSTRACT

A system for driving the damping roller in rotary printing machines. The system has a driving mechanism for the damping roller, while the plate cylinder is being driven separately by an individual driving mechanism, for realizing the delta mode of operation. In this mode of operation, the driving mechanism of the damping roller can be disengaged through a switchable transmission from the driving gear train and connected with the individual driving mechanism of the plate cylinder.

10 Claims, 3 Drawing Sheets

SYSTEM FOR DRIVING DAMPING ROLLERS IN ROTARY PRINTING MACHINES

CROSS REFERENCE TO RELATED APPLICATION

This application claims foreign priority of DE 102004022889.2, filed on May 6, 2004, which is incorporated herein by reference in its entirety.

BACKGROUND OF THE INVENTION

The invention relates to a system for driving a damping roller in a rotary printing machine. The rotary printing machine may have one or more printing units.

Damping rollers, as components of damping systems in rotary printing machines, have the task of transferring damping fluid to the printing plate. They not only keep the printing plate moist, but also remove excess water and continuously free the printing plate from dust and ink particles. These moisture-application rollers are particularly effective if they are driven at a rate different from that of the printing plate cylinder. For this reason, many rotary printing machines are offered with an option for switching from the normal operation (printing plate cylinder and damping roller have the same peripheral speed) to the so-called delta operation (peripheral speed of printing plate cylinder and damping roller are different).

Such a differential drive is known from U.S. Pat. No. 4,724,764. The damping roller, driven at a rate different from that of the surface of the printing plate cylinder, produces a wiping effect on the surface of the printing plate cylinder. This effect frees the cylinder from the deposits formed during the printing process. A damping system having a damping roller driven by the friction cause by the plate cylinder, and having an optional delta operation is described in DE 4414269 C2, wherein the plate cylinder is driven over the main driving gear train and the delta operation can be selected through two clutches.

EP 08 12 683 B1 discloses a driving mechanism for a sheet-fed printing press, for which the cylinders and drums are driven by a main drive motor over a common driving gear train, wherein at least the plate cylinder or the rubber cylinder, which is mechanically uncoupled from the driving gear train, is driven by an individual driving mechanism.

If the damping roller of a rotary printing machine is operated in the delta mode, that is, with a peripheral speed lower than that of the plate cylinder, the plate cylinder is acted upon by a braking moment. If the plate cylinder is driven by an individual driving mechanism and the damping roller is driven by a different motor, such as a main driving mechanism over the driving gear train, the plate cylinder motor, in the delta operation of the damping roller, must provide the frictional moment between the damping roller and the plate cylinder until the plate surface slips with respect to the damping roller. This moment can be very high, depending on the pressing settings.

Individual driving mechanisms of plate cylinders, while the damping system is driven by means of the driving gear train, accordingly have the disadvantage that, in order to realize the delta mode of operation, a very high driving power is required for the individual driving mechanism of the plate cylinder. Furthermore, there is a disadvantageous effect that, by supplying the power of the plate cylinder driving mechanism over the damping roller, the bracing in the driving gear train is decreased and, as a result, stable tooth flank contact is no longer assured.

SUMMARY OF THE INVENTION

It is therefore an object of the present invention to develop a driving mechanism for a damping roller, the plate cylinder being driven separately, in such a manner that the disadvantages of the prior art are eliminated.

This object is accomplished by a system and device for driving a damping roller in rotary printing machines in accordance with the present invention, wherein the cylinder, drums and rollers of at least one printing unit are driven over a continuous driving gear train of at least one main driving mechanism and at least one plate cylinder is not driven over the driving gear train. In the system and device of the present invention,

- the damping roller makes surface contact with a printing block on the plate cylinder;
- an individual drive, which is synchronized with the driving gear train, is assigned to the plate cylinder; and
- the damping roller is drivable with a driving mechanism at a peripheral speed, which is approximately the same as that of an assigned plate cylinder for realizing a first mode of operation, or at a peripheral speed, which deviates from that of an assigned plate cylinder for realizing a second mode of operation, characterized in that the driving mechanism of the damping roller can be connected with the individual driving mechanism.

In accordance with another aspect of the present invention, the driving mechanism of the damping roller can be disconnected over a switchable transmission from the drive train for the second mode of operation and connected with the individual driving mechanism. The switchable transmission comprises

- a loose idler gear on the plate cylinder drive shaft meshing with a gear of the driving gear train and a damping roller driving gear disposed loosely on the damping roller drive shaft and engages the idler gear, and
- a delta driving gear, which is fixed to the drive shaft of the plate cylinder, and is engaged by a damping roller driving gear, which is disposed loosely on the damping roller drive shaft,
- a clutch, disposed on the damping roller drive shaft, so that it cannot be rotated independently but can be shifted axially, engages, in a first position for an operating mode with approximately equal peripheral speeds, the damping roller driving gear and, in a second position for the second mode of operation with deviating peripheral speeds, the delta transmission gear or, in a third position, is not connected either with the damping roller driving gear or with the delta transmission gear.

Alternatively, the switchable transmission comprises:

- on the plate cylinder drive shaft, a loose idler gear meshing with a gear of the driving gear train and, on the damping roller drive shaft, a loosely disposed damping roller driving gear, which engages the idler gear,
- a first clutch, which is disposed on the damping roller drive shaft so that it cannot rotate independently but is axially displaceable and which can connect the damping roller driving gear with the damping roller drive shaft, and
- a delta driving gear, which is disposed on the plate cylinder drive shaft so that it cannot rotate independently, and a clutch gear, which is fixed to the damping roller drive shaft.

The switchable transmission may further comprise:

- a delta transmission gear, which is loosely disposed on a clutch shaft, a second clutch, which is disposed on the clutch shat and by means of which the clutch shaft can be connected with the delta transmission gear, a clutch gear on the clutch shaft, which engages an idler gear, which is mounted in the frame of the rotary printing machine and meshes with the clutch gear, which is mounted on the damping roller driving shaft.

DETAILED DESCRIPTION OF THE INVENTION

Figure 1:
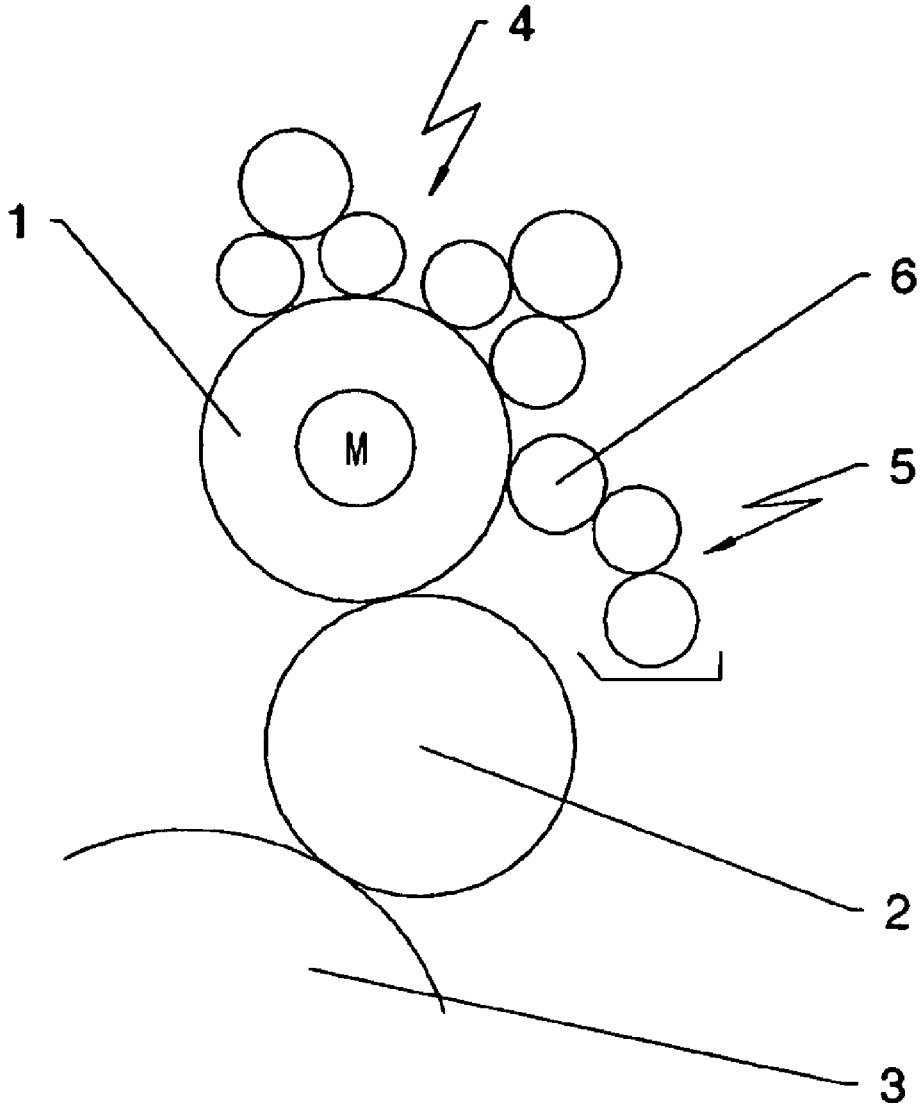
FIG. 1 is a simplified diagram of a printing unit of a rotary printing machine.

The present invention is directed to a system for driving a damping roller in a rotary printing machine, comprising a driving gear train; a plate cylinder having a printing plate, the plate cylinder not being driven by the driving gear train; a plate cylinder drive assigned to the plate cylinder, the plate cylinder being drivable with an individual driving mechanism of the plate cylinder drive; a damping roller which is drivable by the driving gear train, the damping roller making surface contact with the printing plate of the plate cylinder, the damping roller being drivable with a driving mechanism at a peripheral speed, which is approximately the same as that of the plate cylinder for realizing a first mode of operation, or at a peripheral speed which deviates from that of the plate cylinder for realizing a second mode of operation; wherein the damping roller can be connected with the individual driving mechanism of the plate cylinder drive. In the second mode of operation, the driving mechanism of the damping roller is disconnected over a switchable transmission from the driving gear train and connected with the individual driving mechanism of the plate cylinder drive. The plate cylinder drive may be synchronized with the driving gear train. The rotary printing machine may comprise at least one cylinder, at least one drum and rollers in at least one printing unit which are driven over the continuous driving gear train.

The switchable transmission comprises a plate cylinder drive shaft; an idler gear disposed on the plate cylinder drive shaft meshing with a gear of the driving gear train; a damping roller drive shaft; a damping roller driving gear disposed on the damping roller drive shaft and engages with the idler gear; a delta driving gear connected to the plate cylinder drive shaft, the delta driving gear engaging with the damping roller driving gear; a delta transmission gear; and a clutch disposed on the damping roller drive shaft, the clutch being unable to rotate independently but being able to shift axially, the clutch being able to in a first position, engage with the damping roller driving gear for the first mode of operation, in a second position, engage with the delta transmission gear for the second mode of operation, or in a third position, not be connected with either the damping roller driving gear or the delta transmission gear.

Alternatively, the switchable transmission comprises a plate cylinder drive shaft; an idler gear disposed on the plate cylinder drive shaft and meshing with a gear of the driving gear train; a damping roller drive shaft; a damping roller driving gear disposed on the damping roller drive shaft and engaging with the idler gear; a first clutch disposed on the damping roller drive shaft, the first clutch being unable to rotate independently but being axially displaceable, the first clutch being able to connect the damping roller driving gear with the damping roller drive shaft; a delta driving gear on the plate cylinder drive shaft so that it cannot rotate independently; and a clutch gear connected to the damping roller drive shaft. The switchable transmission may further comprise a clutch shaft; a delta transmission gear disposed on the clutch shaft; a second clutch disposed on the clutch shaft, wherein the clutch shaft can be connected with the delta transmission gear through the second clutch; an idler gear mounted on a frame of the rotary printing machine; a clutch gear mounted on the damping roller drive shaft, the clutch gear engaging with the idler gear, the idler gears meshing with the clutch gear.

The invention has the advantage that, when the driving mechanism of the damping roller is coupled with the individual driving mechanism of the plate cylinder, because of the difference in the transmission ratio between the rpm of the damping roller drive shaft and the rpm of the plate cylinder and between the peripheral speed of the damping roller and the peripheral speed of the printing block of the plate cylinder, bracing results between the damping roller and the plate cylinder as well as between their driving mechanisms. Thus, the frictional moment at the surface of the damping roller has a relieving effect on the driving mechanism of the plate cylinder and therefore, reduces the driving power required. By uncoupling the damping roller from the driving gear train, the frictional moment supplied by the driving motor of the plate cylinder is no longer passed onto the driving gear train of the system. Thus, the decrease in the bracing of the driving gear train is avoided.

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

THE FIRST EXAMPLE

Figure 2:
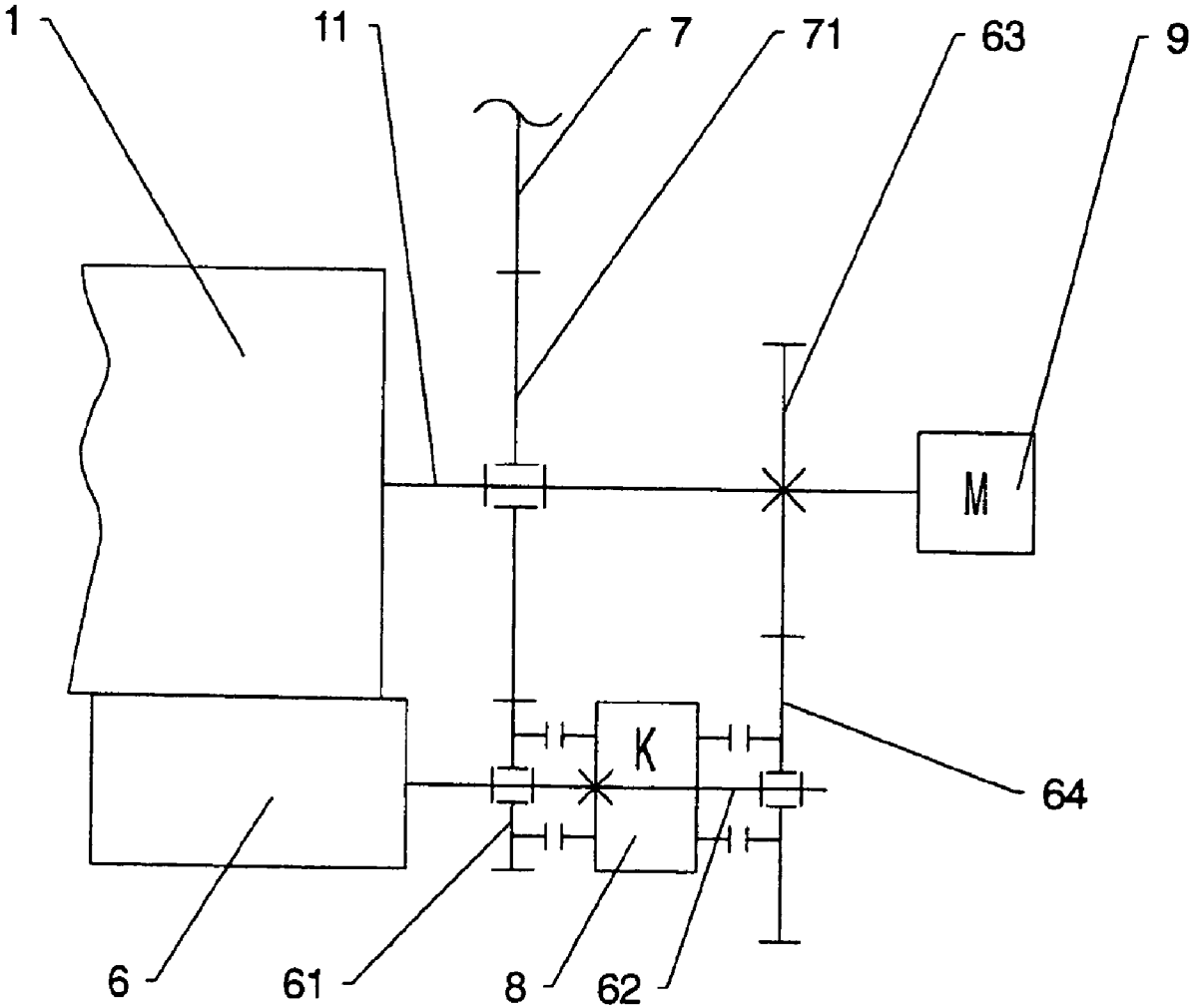
FIG. 2 is a transmission diagram illustrating the driving mechanism of the damping roller in the embodiment with one clutch.

As shown in FIG. 1, a printing unit of a rotary printing machine comprises a plate cylinder 1, to which a rubber blanket cylinder 2 is assigned. The rubber blanket cylinder 2 interacts with an impression cylinder 3. An inking unit 4 for inking a printing plate, which is not shown here, is clamped at the plate cylinder 1 and a damping system 5 is screwed on the plate cylinder. The damping system 5 has a damping roller 6, which supplies the printing plate with a dampening solution. As shown in FIG. 2, a plate cylinder drive motor 9 is assigned to the plate cylinder drive shaft 11.

FIG. 2 shows the individual driving mechanism of the plate cylinder 1 by a plate cylinder driving motor 9 and the driving mechanism of the damping roller 6, which can be switched from the normal operation of the plate cylinder and damping roller to the delta driving mechanism. In a normal operation of a damping roller driving mechanism, the peripheral speed of the damping roller 6 and the peripheral speed of the plate cylinder 1 are the same or substantially the same. A driving mechanism is described as a delta driving mechanism when there is a difference between the peripheral speed of the plate cylinder 1 and that of the damping roller 6.

As shown in FIG. 2, the plate cylinder drive motor 9 is assigned directly to the plate cylinder drive shaft 11. An idler gear 71 is mounted loosely on the plate cylinder drive shaft 11. Thus, it can be rotated independently but is axially secured. The idler gear 71 meshes with a gear of the driving gear train 7, which is a coherent gear train and which starts out from the main driving mechanism of the rotary printing machine. The idler gear 71 also engages with a damping roller driving gear 61, which is also loosely disposed on the damping roller drive shaft 62. In addition to the idler gear 71, there is, on the plate cylinder drive shaft 11, a delta driving gear 63, which is firmly connected with the plate cylinder drive shaft 11. The delta driving gear 63 meshes with a delta transmission gear 64, which is mounted loosely on the damping roller drive shaft 62. A clutch 8 is disposed between the damping roller driving gear 61 and the delta transmission gear 64. This clutch 8 is axially displaceable, but connected with the damping roller drive shaft 62 so that it cannot rotate independently. Moreover, the clutch 8 can assume three positions. In the first position, the clutch 8 is pushed in the direction of the damping roller 6 and engages the damping roller driving gear 61. With that, the normal operation is set. In the second position, the clutch 8 is pushed in the direction of the delta transmission gear 64, with which it engages, so that it can be switched into the delta driving mode. The third position is an intermediate position, in which the clutch 8 is not connected with either the damping roller driving gear 61 or the delta transmission gear 64. The damping roller 6 is running freely and is driven by friction caused by the plate cylinder 1. The operating nature of the system is determined by the position of the clutch 8 in the following manner:

Normal Operation:

For operating the damping roller 6 in the normal manner, the clutch 8 is pushed in the direction of the damping roller 6 and engages with the damping roller drive the 61. Starting out from the driving gear train 7, the damping roller 6 is driven over the idler gear 71 and the damping roller driving gear 61. At the same time, the clutch 8 passes on the torque, which is transmitted from the idler gear 71 to the damping roller driving gear 61, to the damping roller drive shaft 62. The plate cylinder 1 is driven by the plate cylinder drive motor 9 over the plate cylinder drive shaft 11. The delta transmission gear 64 is likewise driven over the delta driving gear 63, but does not transmit any torque to the damping roller drive shaft 62, since the delta transmission gear 64 is not coupled to the clutch 8.

Delta Drive Operation:

In order to operate the damping roller 6 in the delta driving mode, the clutch 8 is pushed in the direction of the delta transmission gear 64 and engages with it. The damping roller 6 is now driven by the plate cylinder drive motor 9. At the same time, the torque is transferred from the delta driving gear 63 to the delta transmission gear 64. Due to the position of the clutch 8, the torque can be transferred to the damping roller drive shaft 62. The peripheral speed of the damping roller 6, required for the delta operation and deviating from the peripheral speed of the plate cylinder 1, can be achieved by selecting the appropriate gearwheel transmission ratio. The plate cylinder 1 is driven by the plate cylinder drive motor 9 over the plate cylinder drive shaft 11.

Friction Drive Operation:

The clutch 8 assumes an intermediate position. Torque is not provided either from the driving gear train 7 or from the plate cylinder drive motor 9 to the damping roller 6. The damping roller 6 is in contact with the plate cylinder 1 and is driven by friction.

THE SECOND EXAMPLE

Figure 3:
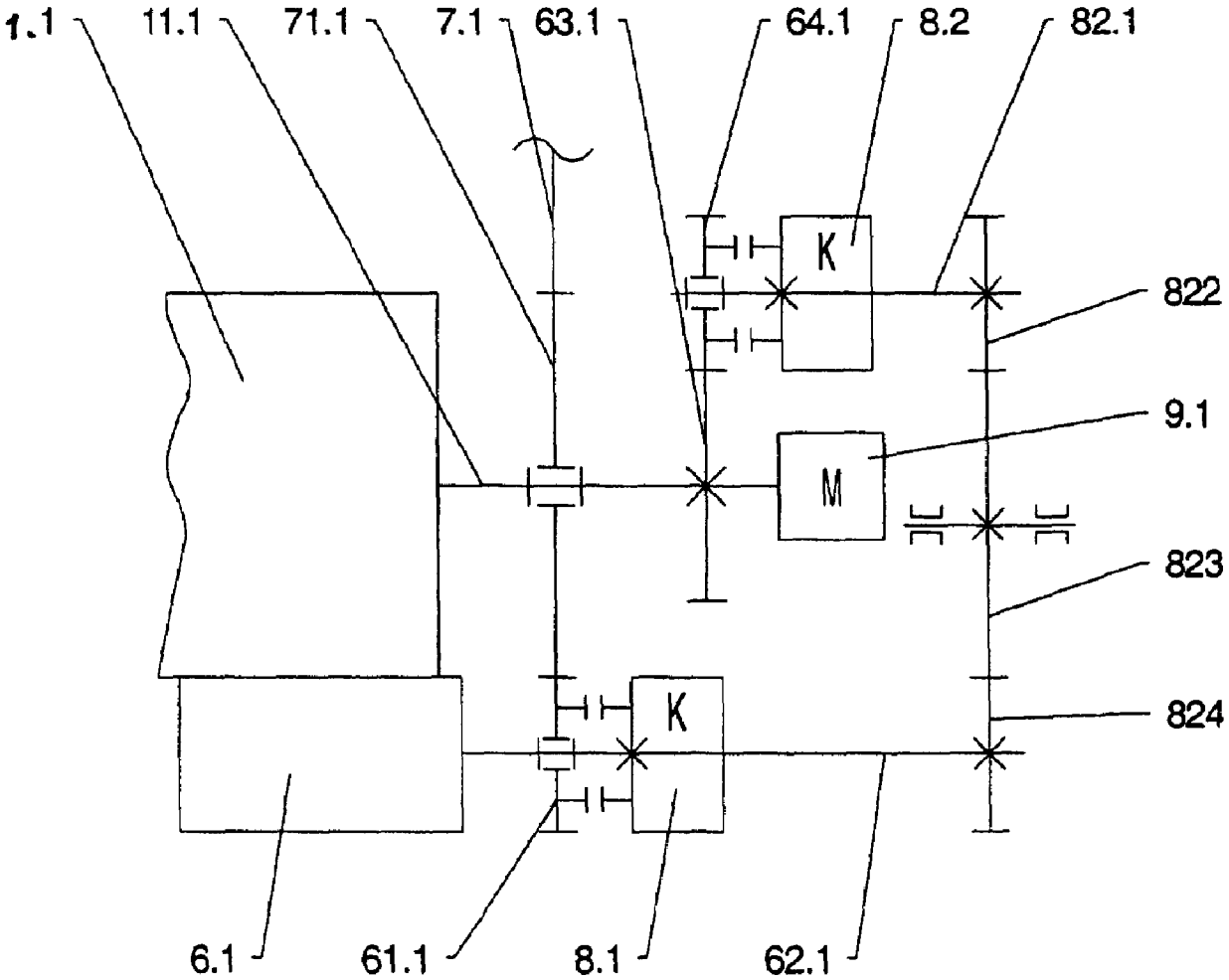
FIG. 3 is a transmission diagram illustrating the driving mechanism of the damping roller in the embodiment with two clutches.

The transmission diagram of FIG. 3 shows the individual driving mechanism of a plate cylinder 1.1, which can be brought about by means of a plate cylinder drive motor 9.1, and the driving mechanism of a damping roller 6.1, which can be switched to a delta driving mechanism. In contrast to the first example, two clutches 8.1, 8.2 are used in this embodiment.

As shown in FIG. 3, the plate cylinder drive motor 9.1 is assigned directly to the plate cylinder drive shaft 11.1. An idler gear 71.1 is loose, which means that it is mounted on the plate cylinder drive shaft 11.1 so that it can be rotated independently but is axially secured. The idler gear 71.1 meshes with a gear of the driving mechanism of the gear train 7.1, which is a coherent gear train and which starts out from the main driving mechanism of the rotary printing machine. The idler gear 71.1 also engages a damping roller driving gear 61.1, which is also disposed loosely on the damping roller drive shaft 62.1. Furthermore, a first clutch 8.1, which can connect the damping roller driving gear 61.1 with the damping roller drive shaft 62.1, is mounted on the damping roller drive shaft 62.1. A delta driving gear 63.1, which is disposed on the plate cylinder drive shaft 11.1 so that it cannot rotate, meshes with a delta transmission gear 64.1, which is disposed loosely so that it can rotate but is axially secured, on a clutch shaft 82.1. Furthermore, a second clutch 8.2, by means of which the clutch shaft 82.1 can be connected with the delta transmission gear 64.1, is disposed on the clutch shaft 82.1. Furthermore, a clutch gear 822, which engages an idler gear 823 mounted in the frame of the rotary printing machine, is located on the clutch shaft 82.1. The idler gear 823 meshes with a clutch gear 824, which is fixed to the damping roller drive shaft 62.1.

The mode of operation of the system is determined by the positions of the two clutches 8.1, 8.2 in the following manner:

Normal Operation:

For operating the damping roller 6.1 in the normal mode of operation, the clutch 8.1 is pushed in the direction of the damping roller 6.1 and engages the damping roller drive gear 61.1. Starting out from the driving gear train 7.1, the damping roller 6.1 is driven over the idler gear 71.1 and the damping roller driving gear 61.1. At the same time, the clutch 8.1 passes the torque, transmitted from the idler dear 71.1 to the damping roller driving gear 61.1, onto the damping roller drive shaft 62.1.

The plate cylinder 1.1 is driven by the plate cylinder drive motor 9.1 over the plate cylinder drive shaft 11.1. The delta transmission gear 64.1 is also driven over the delta driving gear 63.1. However, it does not transmit a torque to the damping roller drive shaft 62.1, since the second clutch 8.2 is not engaged and thus, there is no connection between the second clutch 8.2 and the delta transmission gear 64.1

Delta Operation:

For operating the damping roller 6.1 in the delta driving mode, the clutch 8.1 is pushed in the direction of the coupling gear 824, with which it disengages. The first clutch 8.1 is disconnected from the damping roller driving gear 61.1. The second clutch 8.2 is moved in the direction of the delta transmission gear 64.1 and thus connects the delta transmission gear 64.1 with the coupling shaft 82.1. The torque, produced by the plate cylinder drive motor 9.1, is transferred over the delta driving gear 63.1, the clutch gear 822, the idler gear 823 and the clutch gear 824 to the damping roller drive shaft 62.1 and accordingly to the damping roller 6.1. The peripheral speed of the damping roller 6.1 necessary for the delta operation and deviating from the peripheral speed of the plate cylinder 1.1, can be achieved by the appropriate selection of the gearwheel transmission ratios. The plate cylinder 1.1 is driven by the plate cylinder drive motor 9.1 over the plate cylinder drive shaft 11.1.

Friction Drive Operation:

When both clutches are disengaged, torque is not transmitted from the driving gear train 7.1 or from the plate cylinder drive motor 9.1 to the damping roller 6.1. The damping roller 6.1 is driven by friction by the plate cylinder 1.1.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

The invention claimed is:

1. A rotary printing machine having at least one printing unit, said machine comprising:

a) a continuous driving gear train of the press operably connectable with a damping roller, said continuous driving gear train having at least one main press drive for driving said at least one printing unit;

b) a plate cylinder having a printing plate;

c) an individual plate cylinder drive motor, said plate cylinder driven by said individual plate cylinder drive motor and disconnected from said driving gear train;

d) said damping roller making surface contact with said printing plate of said plate cylinder; and e) a switchable gear transmission, said damping roller being switchably connectable with said individual plate cylinder drive motor or with said driving gear train by said switchable gear transmission, said switchable gear transmission providing:

a first mode of operation, wherein said damping roller is disconnected from said plate cylinder drive motor and is driven by said driving gear train at approximately the same peripheral speed as that of said plate cylinder, and a second mode of operation, wherein said damping roller is disconnected from said driving gear train and is driven by said individual plate cylinder drive motor at a peripheral speed which deviates from that of said plate cylinder while still in surface contact with said printing plate of said plate cylinder.

2. The machine of claim 1, further comprising a delta driving gear, wherein in said second mode of operation, said damping roller is disconnected from said driving gear train and connected with said individual plate cylinder drive motor through said delta driving gear.

3. The machine of claim 1, said rotary printing machine further comprising a printing unit which comprises a cylinder, a drum and a roller, wherein said driving gear train is a continuous driving gear train, and wherein said printing unit is driven over said continuous driving gear train.

4. The machine of claim 1, wherein said plate cylinder drive is synchronized with said driving gear train.

5. A rotary printing machine comprising:

a) a driving gear train operably connectable with a damping roller said driving gear train having at least one main drive;

b) a plate cylinder having a printing plate, said plate cylinder driven by an individual plate cylinder drive motor and disconnected from said driving gear train;

c) said damping roller making surface contact with said printing plate of said plate cylinder; and d) a switchable gear transmission, said damping roller being switchably connectable with said individual plate cylinder drive motor or with said driving gear train by said switchable gear transmission, said switchable gear transmission adapted to provide:

a first mode of operation, wherein said damping roller is disconnected from said plate cylinder drive motor and is driven by said driving gear train at approximately the same peripheral speed as that of said plate cylinder, and a second mode of operation, wherein said damping roller is disconnected from said driving gear train and is driven by said individual plate cylinder drive motor at a peripheral speed which deviates from tat of said plate cylinder;

said switchable gear transmission comprising:

i) a plate cylinder drive shaft, said plate cylinder drive shaft meshing with a gear of said driving gear train;

ii) an idler gear disposed on said plate cylinder drive shaft;

iii) a damping roller drive shaft;

iv) a damping roller driving gear disposed on said damping roller drive shaft and engaged with said idler gear;

v) a delta driving gear firmly connected to said plate cylinder drive shaft, and engaged with said damping roller driving gear;

vi) a delta transmission gear; and vii) a clutch disposed on said damping roller drive shaft, said clutch being unable to rotate independently, but able to shift axially, wherein said clutch either:

engages in a first position with said damping roller driving gear for operating in said first mode of operation, engages in a second position with said delta transmission gear for operating in said second mode of operation, or disengages from both said damping roller driving gear and said delta transmission gear for a friction drive operation.

6. The machine of 5, wherein said idler gear is loosely disposed on said plate cylinder drive shaft and said damping roller driving gear is loosely disposed on said damping roller drive shaft.

7. A rotary printing machine comprising:

a) a driving gear train operably connectable with a damping roller said driving gear train having at least one main drive;

b) a plate cylinder having a printing plate, said plate cylinder driven by an individual plate cylinder drive motor and disconnected from said driving gear train;

c) said damping roller making surface contact with said printing plate of said plate cylinder, and d) a switchable gear transmission, said damping roller being switchably connectable with said individual plate cylinder drive motor or with said driving gear train by said switchable gear transmission, said switchable gear transmission adapted to provide:

a first mode of operation, wherein said damping roller is disconnected from said plate cylinder drive motor and is driven by said driving gear train at approximately the same peripheral speed as that of said plate cylinder, and a second mode of operation, wherein said damping roller is disconnected from said driving gear train and is driven by said individual plate cylinder drive motor at a peripheral speed which deviates from that of said plate cylinder;

said switchable gear transmission comprising:

i) a plate cylinder drive shaft, said plate cylinder drive shaft meshing with a gear of said driving gear train;

ii) a first idler gear disposed on said plate cylinder drive shaft;

iii) a damping roller drive shaft;

iv) a damping roller driving gear disposed on said damping roller drive shaft and engaged with said idler gear;

v) a first clutch disposed on said damping roller drive shaft, said first clutch being unable to rotate independently but able to shift axially, said first clutch being able to connect said damping roller driving gear with said damping roller drive shaft for operating in said first mode of operation;

vi) a delta driving gear firmly connected to said plate cylinder drive shaft so that it cannot rotate independently; and vii) a clutch gear connected to said damping roller driver shaft.

8. The machine of claim 7, wherein said idler gear is loosely disposed on said plate cylinder drive shaft and said damping roller driving gear is loosely disposed on said damping roller drive shaft.

9. The machine of claim 7, said switchable gear transmission further comprising:

viii) a clutch shaft;

ix) a delta transmission gear disposed on said clutch shaft;

x) a second clutch disposed on said clutch shaft, wherein said clutch shaft can be connected with said delta transmission gear through said second clutch for operating in said second mode of operation;

xi) a second idler gear mounted on a frame of said rotary printing machine; and xii) a clutch gear mounted on said damping roller drive shaft, said clutch gear engaging said second idler gear, said idler gear meshing with said clutch gear.

10. The machine of claim 9, wherein said delta transmission gear is loosely disposed on said clutch shaft.

* * * * *